US009905978B2

(12) United States Patent
Zebhauser et al.

(10) Patent No.: US 9,905,978 B2
(45) Date of Patent: Feb. 27, 2018

(54) INSERTION-TYPE CONNECTOR HAVING A TWISTED-PAIR CABLE

(71) Applicant: ROSENBERGER HOCHFREQUENZTECHNIK GMBH & CO. KG, Fridolfing (DE)

(72) Inventors: Martin Zebhauser, Laufen (DE); Christian Biermann, Salzburg (AT); Till Bredbeck, Traunstein (DE); Thomas Müller, Berchtesgaden (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 14/418,284

(22) PCT Filed: Jul. 9, 2013

(86) PCT No.: PCT/EP2013/002024
§ 371 (c)(1),
(2) Date: Jan. 29, 2015

(87) PCT Pub. No.: WO2014/023383
PCT Pub. Date: Feb. 13, 2014

(65) Prior Publication Data

US 2015/0349472 A1 Dec. 3, 2015

(30) Foreign Application Priority Data

Aug. 7, 2012 (DE) ..... 10 2012 015 581

(51) Int. Cl.
*H01R 13/58* (2006.01)
*H01R 24/38* (2011.01)
(Continued)

(52) U.S. Cl.
CPC ..... *H01R 24/38* (2013.01); *H01R 13/6463* (2013.01); *H01R 43/20* (2013.01);
(Continued)

(58) Field of Classification Search
CPC .... H01R 23/7073; H01R 23/02; H01R 24/60; H01R 13/502; H01R 13/516; H01R 23/005
(Continued)

(56) References Cited

U.S. PATENT DOCUMENTS 4,029,384 A * 6/1977 Reinwall, Jr. ..... H01R 4/245 439/397
4,089,580 A * 5/1978 Huffnagle ..... H01R 4/2445 439/400
(Continued)

FOREIGN PATENT DOCUMENTS

CN 2342490 Y 10/1999
CN 2571024 Y 9/2003
(Continued)

*Primary Examiner* — Abdullah Riyami
*Assistant Examiner* — Thang Nguyen
(74) *Attorney, Agent, or Firm* — Robert Curcio; DeLio, Peterson & Curico LLC

(57) ABSTRACT

An insertion-type connector having a housing and at least two contact elements fixed within the housing, which are designed for connection to two cores of a twisted-pair cable, wherein the housing forms a guide by which the cores are fixed in a twist which continues the twist of the twisted-pair cable. A system having such an insertion-type connector and a twisted-pair cable is taught, and a method of producing the same.

7 Claims, 4 Drawing Sheets

(51) Int. Cl.
*H01R 43/20* (2006.01)
*H01R 13/6463* (2011.01)
*H01R 107/00* (2006.01)
*H01R 12/75* (2011.01)

(52) U.S. Cl.
CPC ..... *H01R 12/75* (2013.01); *H01R 13/5833* (2013.01); *H01R 2107/00* (2013.01); *Y10T 29/4921* (2015.01)

(58) Field of Classification Search
USPC ..... 439/660, 941, 465, 638
See application file for complete search history.

(56) References Cited

U.S. PATENT DOCUMENTS 4,211,462 A * 7/1980 Wolfthal ..... H01R 12/772 439/391
4,326,767 A * 4/1982 Silbernagel ..... H01R 4/2454 439/392
4,612,423 A * 9/1986 Munroe ..... H01H 1/585 200/16 R
5,113,037 A * 5/1992 King, Jr. ..... H01R 4/22 174/87
5,498,172 A * 3/1996 Noda ..... H01R 12/616 439/404
5,651,691 A * 7/1997 Grumel ..... H01R 4/2454 439/395
5,855,493 A * 1/1999 Shelly ..... H01R 13/516 439/465
6,007,368 A * 12/1999 Lorenz ..... H01R 13/6463 439/418
6,123,572 A 9/2000 Ishii et al.
6,227,899 B1 * 5/2001 Bogese, II ..... H01R 13/6463 439/418
6,315,596 B1 11/2001 Chen
6,328,592 B1 * 12/2001 Burke ..... H01R 4/2429 439/404
6,398,580 B2 * 6/2002 Lin ..... H01R 4/245 439/402
6,524,127 B2 * 2/2003 Turek ..... H01R 4/2425 439/389
6,821,142 B1 * 11/2004 Rayev ..... H01R 13/6463 439/344
6,837,737 B2 * 1/2005 Baier ..... H01R 12/616 439/402
7,335,066 B2 * 2/2008 Carroll ..... H01R 4/2429 174/27
7,713,094 B1 * 5/2010 Sparrowhawk .... H01R 13/6463 439/676
7,857,655 B2 * 12/2010 Gyagang ..... H01R 4/2462 439/404
2008/0014801 A1 * 1/2008 Milette ..... H01R 4/242 439/638
2009/0104819 A1 * 4/2009 Hermant ..... H01R 13/6474 439/638
2010/0330837 A1 12/2010 Wegener
2011/0065308 A1 * 3/2011 Lu ..... H01B 7/0892 439/449
2011/0256756 A1 * 10/2011 Lu ..... H01B 7/0892 439/449

FOREIGN PATENT DOCUMENTS

| | | | |
|---|---|---|---|
| CN | 2572617 | Y | 9/2003 |
| CN | 2599837 | Y | 1/2004 |
| DE | 19649668 | C1 | 5/1998 |
| FR | 52983 | E | 8/1945 |
| GB | 2027290 | A | 2/1980 |
| JP | 6-36247 | | 5/1994 |
| JP | 07-169526 | A | 4/1995 |
| TW | 096342 | | 2/1988 |
| WO | 20080067268 | A1 | 6/2008 |

* cited by examiner

INSERTION-TYPE CONNECTOR HAVING A TWISTED-PAIR CABLE

BACKGROUND OF THE INVENTION

1. Field of the Invention

The invention relates to an insertion-type connector having a housing and at least two contact elements fixed within the housing which are designed for connection to two cores of a twisted-pair cable. The invention also relates to a system having an insertion-type connector of this kind and a twisted-pair cable. and to a method of producing such a system.

2. Description of Related Art

Twisted-pair cables have long been known from the field of signal and data transmission. Twisted-pair is a name for cables in which the cores (the conductors surrounded by an insulating sheath) are twisted together in pairs. Compared with cables in which the pairs of cores run in parallel, twisted-pair cables give, by virtue of their twisted pairs of cores, better protection against alternating external magnetic fields and against electrostatic effects because, when signal transmission is symmetrical due to the twisting of the pairs of cores, the effects caused by external fields very largely cancel each other out.

Insertion-type connectors are used to connect together electrically conductive items, e.g., cables, with an electrically conductive connection. When a twisted-pair cable is connected to a conventional insertion-type connector, provision is made for a defined portion of the outer protective sheath surrounding the cores to be removed, this portion being one in which said cores are guided within a housing of the insertion-type connector. Those ends of the cores which have been freed of their insulation are then durably connected to contact elements of the insertion-type connector. The contact elements in turn are in a fixed state in the housing. Within the housing, i.e., for the length of the portion from which the protective sheath has been removed, the cores extend substantially in parallel. This portion of the twisted-pair cable might thus be exposed to being more severely influenced by external fields. To avoid an increased influence of this kind, provision is regularly made for shielding to be incorporated in the insertion-type connector and particularly in the housing of the insertion-type connector. This however leads to relatively high costs for the insertion-type connector because the possibility no longer exists of forming the housing in an inexpensive way from an electrically insulating, i.e., nonconductive, plastics material.

SUMMARY OF THE INVENTION

Taking the above prior art as a point of departure, the object underlying the invention was to specify a system having an insertion-type connector and a twisted-pair cable whose production costs were as low as possible. This object is achieved by an insertion-type connector and a system as defined in the claims. A method of producing a system according to the invention is also claimed. Advantageous embodiments of the insertion-type connector according to the invention and the system according to the invention form the subject matter of the claims and can be seen from the following description of the invention.

The above and other objects, which will be apparent to those skilled in the art, are achieved in the present invention which is directed to a connector system comprising an insertion-type connector including: a housing; at least two contact elements fixed within the housing; and a twisted-pair cable, two cores of the twisted-pair cable being connected to the contact elements with an electrically conductive connection; the housing forming a guide by which the two cores are fixed in a twist which continues the twist of the twisted-pair cable, the cores being guided to the contact elements while still in the twist, such that, to form the guide, the housing includes, in a guiding space, at least one guiding spigot which extends transversely to a plane defined by the longitudinal axes of the contact elements and around which the cores are guided in arcs.

In the preferred embodiment, the housing does not include shielding, and may be formed from electrically insulating plastics material.

The two contact elements are preferably of an elongated form and are arranged parallel to one another.

The housing may be made in two parts, with a division in side-walls which are intersected by the plane defined by the longitudinal axes of the contact elements.

In a second aspect, the present invention is directed to a method of producing a connector system comprising an insertion-type connector, which has a housing and at least two contact elements fixed within the housing, and a twisted-pair cable, the housing having in a guiding space, to form a guide, at least one guiding spigot which extends transversely to a plane defined by the longitudinal axes of the contact elements, according to claim 1, the method including: connecting with an electrically conductive connection of two cores of the twisted-pair cable to the contact elements; twisting of a first portion of the cores situated adjacent the contact elements; fixing the first portion of the cores in the housing with the twist, in such a way that the cores are guided around the guiding spigot in arcs and are guided to the contact elements while still in the twist; and twisting of the remaining portion of the cores.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
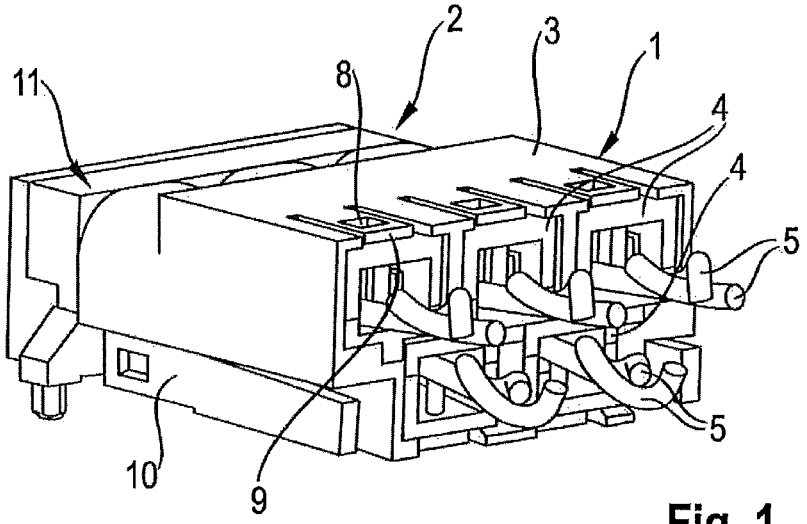
FIG. 1 is a first perspective view of an insertion-type connection having an insertion-type printed circuit board connector and a multiple insertion-type connector.

In describing the preferred embodiment of the present invention, reference will be made herein to FIGS. 1-9 of the drawings in which like numerals refer to like features of the invention.

The idea underlying the invention is to reduce the production costs of an insertion type connector which is intended for connection to a twisted-pair cable, and hence too the production costs of a system comprising an insertion-type connector and a twisted-pair cable, by dispensing with the incorporation of shielding in the housing of the insertion-type connector.

In order in so doing not to have to accept any substantial degradation of the electrical properties, a further fundamental idea behind the invention is for the twist of the cores of the twisted-pair cable not to be untwisted in the portion in which it is freed of the protective sheath and guided within the housing but for the twist to continue, preferably in an identical form. The advantageous electrical properties which twisted-pair cables have due to the twist of the cores can thus be transferred to the insertion-type connector without the need for shielding to be incorporated to achieve this.

An insertion-type connector according to the invention thus comprises at least one housing and at least two contact elements fixed within the housing which are designed for connection to two cores of a twisted-pair cable and which are intended to make contact with contact elements of a mating insertion-type connector, the housing forming a guide by which the cores are fixed in a twist which continues the twist of the twisted-pair cable. The guidance by the housing stops the twist from untwisting and thus compensates for the absence of the outer protective sheath which in twisted-pair cables fixes the position of the cores relative to one another and hence the twist. A corresponding system according to the invention comprises an insertion-type connector, which has at least one housing and at least two contact elements fixed within the housing, and a twisted-pair cable, with two cores of the twisted-pair cable being connected to the contact elements with an electrically conductive connection, wherein the cores are guided within the housing in a twist which continues the twist of the twisted-pair cable.

Provision is preferably made in this case for the insertion-type connector to be designed in accordance with the invention, i.e., for its housing to form a guide by which the cores are fixed in a twist which continues the twist of the twisted-pair cable. Alternatively, the possibility also exists of the fixing of the twist of the cores guided within the housing of the insertion-type connector being achieved by other provisions, such for example as by incorporating the conductors in a separate component or in a substance which sets or cures hard, or by allowing the protective sheath of the twisted-pair cable to continue for a considerable distance into the housing and preferably as far as the contact elements.

Particularly good electrical properties for the insertion-type connector according to the invention can be obtained by, as far as is possible, guiding the cores right to the contact elements while still in the twist. A major advantage of the insertion-type connector according to the invention is that, due to the continued twist of the cores in the housing, it is relatively insensitive to interference by external fields even without any additional shielding.

Hence, in a preferred embodiment of insertion-type connector according to the invention, provision is also made for the housing not to have any shielding. This makes possible a particularly preferred refinement in which the housing is formed (preferably entirely) from electrically insulating plastics material. A housing of this kind can be inexpensively produced in large numbers as an injection molding.

To produce the guidance in the housing, provision may preferably be made for the housing to have at least one and preferably two or more guiding spigots which extend into a guiding space formed by the housing, in which the cores are guided. The cores are guided around these spigots in arcs, whereby, in conjunction with the inner walls of the guiding space, the twist of the cores can be fixed.

The spigots preferably extend in this case transversely, and preferably perpendicularly, to a plane which is defined by longitudinal axes of the contact elements, which latter are of an elongated and in particular cylindrical form. As a particular preference, provision may be made in this case for the spigots to be arranged at an identical distance from the longitudinal axes of the two contact elements. What can be achieved by this layout is that those portions of the cores of the twisted-pair cable which are guided in the housing are of substantially the same length, which has a fundamentally beneficial effect on the electrical properties of the system according to the invention.

A further advantageous embodiment of insertion-type connector according to the invention, which is particularly able to simplify the production of the housing by injection molding and the assembly thereof, may make provision for the housing to be made in two parts, with the division provided in those side-walls which are intersected by the plane defined by the longitudinal axes of the contact elements. As a particular preference, the plane(s) of division may extend parallel to this plane defined by the longitudinal axes of the contact elements. In conjunction with guiding spigots which extend substantially perpendicularly to the plane defined by the longitudinal axes of the contact elements, this enables the halves of the housing not to have any undercuts (in a direction of demolding) and therefore to be produced in injection molds which manage without, for example, sliders.

The invention also relates to a method of producing a system according to the invention, having the following steps: (a) connection of the cores to the contact elements; (b) twisting of a first portion of the cores situated adjacent the contact elements; (c) fixing of the first portion of the cores in the housing, with the twist; and (d) twisting of the remaining portion of the cores.

An advantage of the method according to the invention is that the insertion-type connector may advantageously be used to clamp the cores into a twisting apparatus.—

Figure 2:
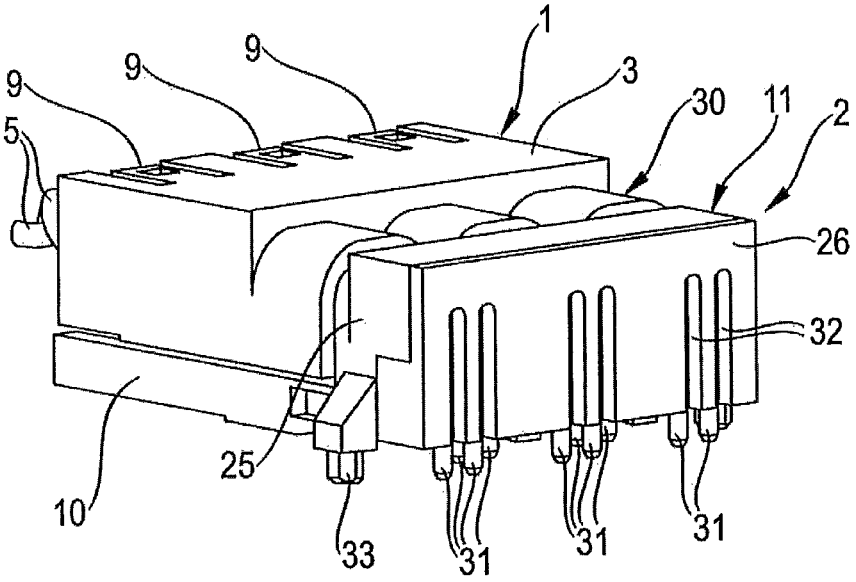
FIG. 2 is a second perspective view of the insertion-type connection shown in FIG. 1.
Figure 3:
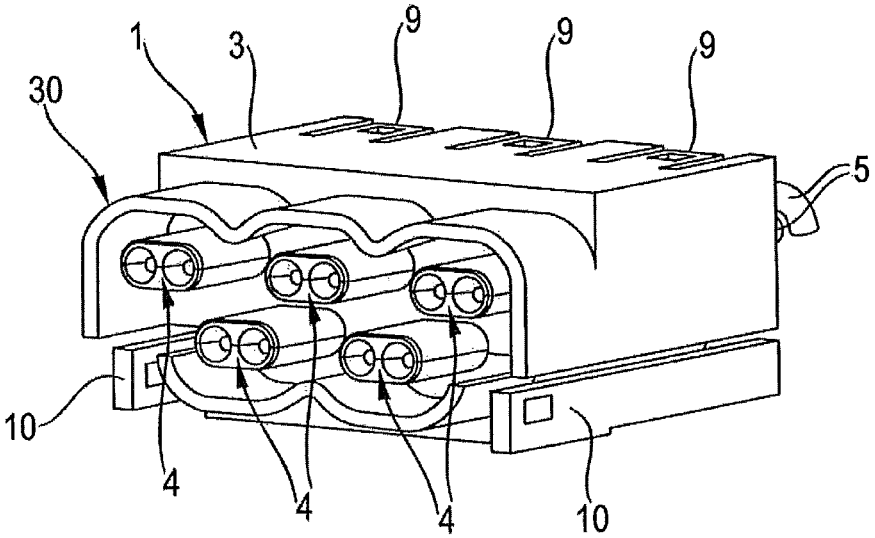
FIG. 3 is a perspective view of the multiple insertion-type connector.

FIGS. 1 and 2 show an insertion-type connection comprising a multiple insertion type connector 1 and a (multiple) insertion-type printed circuit board connector 2 which is used as a mating insertion-type connector. The multiple insertion-type connector 1 comprises a housing 3 which has a plurality (a total of five in the present embodiment) of receiving openings arranged in parallel. One insertion-type connector 4 according to the invention having a twisted-pair cable (of which only portions of the cores 5 are shown) connected to it is inserted in each of these receiving openings and is secured in position therein by a latching connection.

The latching connection is formed in each case by a projection 6 which is formed on an outer side of a housing 7 of the given insertion type connector 4, and by an undercut in the form of a through-opening 8 which is formed in a tongue for latching 9 on the housing 3 of the multiple insertion-type connector 1. As the insertion-type connectors 4 are inserted in the receiving openings, the projections 6, which slope up obliquely, deflect the tongues for latching 9 until the projections 6 engage in the through-openings 8 in the latching tongues 9. To release the latching connection, it is possible for the given tongue for latching 9 to be raised manually and thus brought out of engagement with the associated projection.

The housing 7 of the multiple insertion-type connector 1 also comprises two lateral tongues for latching 10 which are intended to make a latching connection to a housing 11 of the insertion-type printed circuit board connector 2, which has for this purpose projections 12 which slope up obliquely in the appropriate way.

Figure 4:
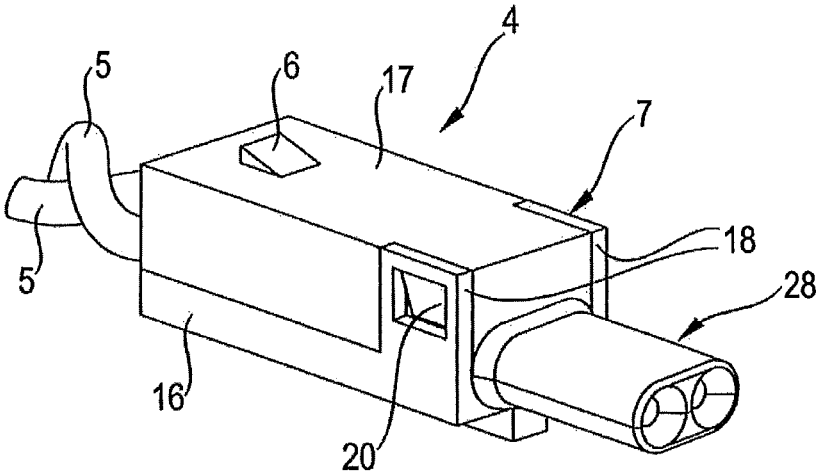
FIG. 4 is a perspective view of an individual insertion-type connector of the multiple insertion-type connector.
Figure 5:
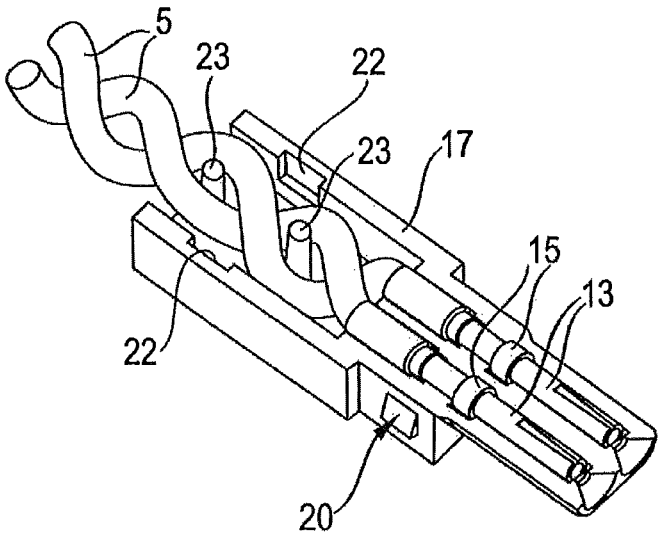
FIG. 5 is a perspective view of a part of the individual insertion-type connector shown in FIG. 4.
Figure 6:
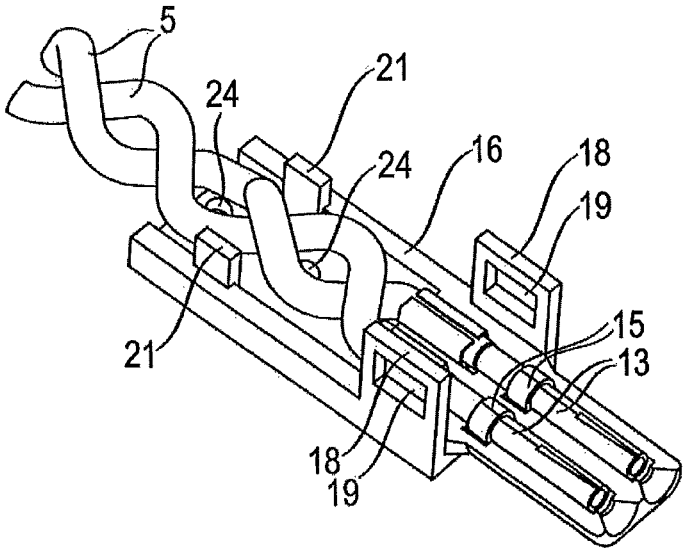
FIG. 6 is a perspective view of a part of the individual insertion-type connector shown in FIG. 4.

FIGS. 4 to 6 are views which show, in isolation, one of the insertion-type connectors 4 according to the invention together with the twisted cores 5 (electrically conductive conductors and insulating sheaths) of a twisted-pair cable which is connected thereto. As well as the housing 7, the insertion-type connector 4 also comprises two contact elements 13 which are mounted in the housing 7 in a fixed position (at least in the direction defined by their longitudinal axes) and which have insertion and cable ends. At their cable ends, the contact elements 13 are connected by crimped connections to stripped portions of respective ones of the two cores 5 of the twisted-pair cable.

The insertion ends are designed to make contact with complementary contact elements 14 of the insertion-type printed circuit board connector 2, the contact elements 13 in socket form of the insertion type connector 4 receiving contact elements 14 in pin form of the insertion-type printed circuit board connector 2, and in so doing being expanded elastically in the radial direction, which is possible due to appropriate longitudinal slots. The fixing of the contact elements 13 in position in the housing 7 is effected by respective surrounding projections 15 which are arranged in surrounding grooves in the housing 7.

The housing 7 of the insertion-type connector 4 comprises two parts 16, 17. The plane of division between these parts 16, 17 of the housing extends in this case in parallel with, and in particular co-planarly with, that plane which is defined by the longitudinal axes of the two contact elements 13. A long-lasting connection between the two parts 16, 17 of the housing is obtained by two tongues for latching 18 on a first one (16) of the parts of the housing, in whose undercuts (in the form of through-openings 19) projections 20 on the second one (17) of the parts of the housing engage. There are also two projections 21 on the first part 16 of the housing which engage in complementary depressions 22 in the second part 17 of the housing and which serve as an additional means of securing the two parts 16, 17 of the housing in position relative to one another.

The cores 5 of the twisted-pair cable extend along a twisted path even within the housing 7 of the insertion-type connector 4. For the cores 5, the housing 7 forms a guide which ensures that the twist is permanent and cannot come untwisted. The guidance so provided is achieved by the inner walls of a guiding space formed by the housing 7, acting in conjunction with two guiding spigots 23 which extend in the guiding space in a direction perpendicular to the plane defined by the longitudinal axes of the two contact elements and centrally between these two longitudinal axes. The guiding spigots 23 are formed in this case by the second part 17 of the housing and, for stabilization, engage in depressions 24 in the first part 16 of the housing.

Continuing the twisted path along which they are guided within the twisted-pair cable, the cores 5 of the cable are guided round the guiding spigots 23 in arcs, and are thus looped partway round them. Provision may also be made in this case for at least portions of the cores 5 to be clamped in, at respective points, between the guiding spigots 23 and the inner walls of the guiding space in the housing 7 or between the inner walls of the housing 7 and whichever is the other core 5. Relatively high tensile loads can thus be transmitted by the twisted-pair cable to the housing 7. This thus provides strain relief for the crimped connections between the cores 5 and the contact elements 13. The two parts 16, 17 of the housing of the insertion-type connector 4 are formed entirely of electrically non-conductive plastics material, with the simple geometrical shape making advantageous injection molding possible. In a demolding direction which is aligned in the direction defined by the longitudinal axes of the guiding spigots 23, only the first half 16 of the housing has undercuts, in the form of the through-openings 19 in the tongues for latching 18. However, because the tongues for latching 18 are designed to be elastically deflectable precisely because of their function, it is possible even for the first part 16 of the housing to be demolded without the use of sliders or the like.

Separate shielding is not provided for the insertion-type connector 4. However, crosstalk between the individual insertion-type connectors 34 which are combined in the multiple insertion-type connector 1 is sufficiently low for many applications due to the twist of the conductors 5, which continues as far as the contact elements 13.

Figure 7:
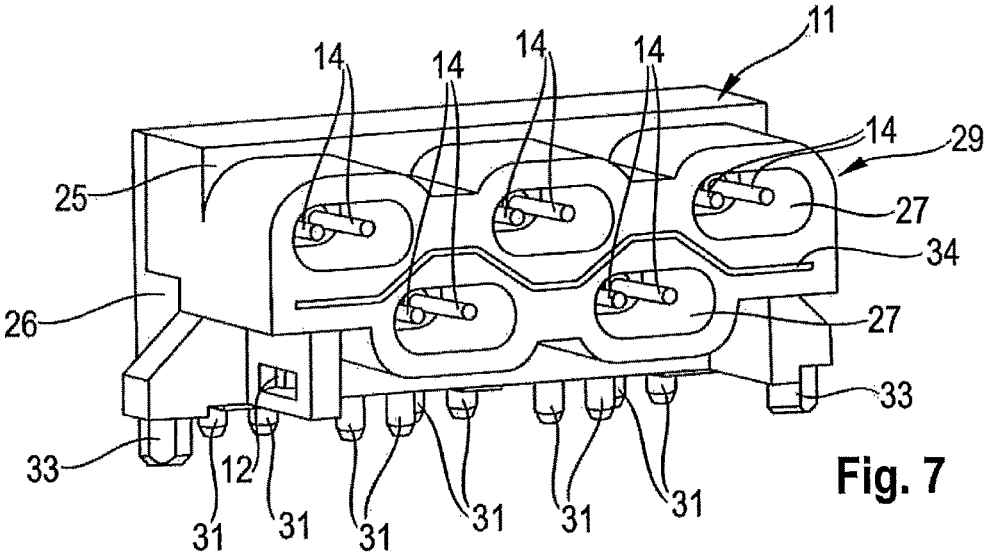
FIG. 7 is a first perspective view of the insertion-type printed circuit board connector.
Figure 8:
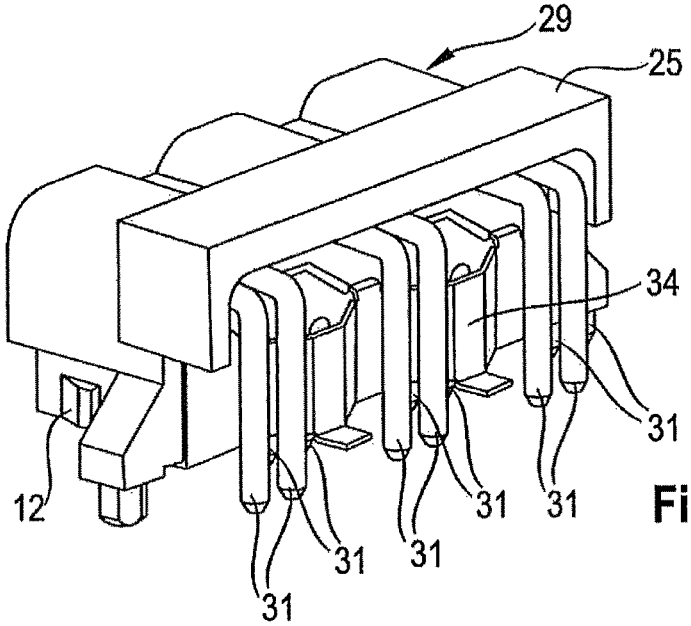
FIG. 8 is a second perspective view of the insertion-type printed circuit board connector.
Figure 9:
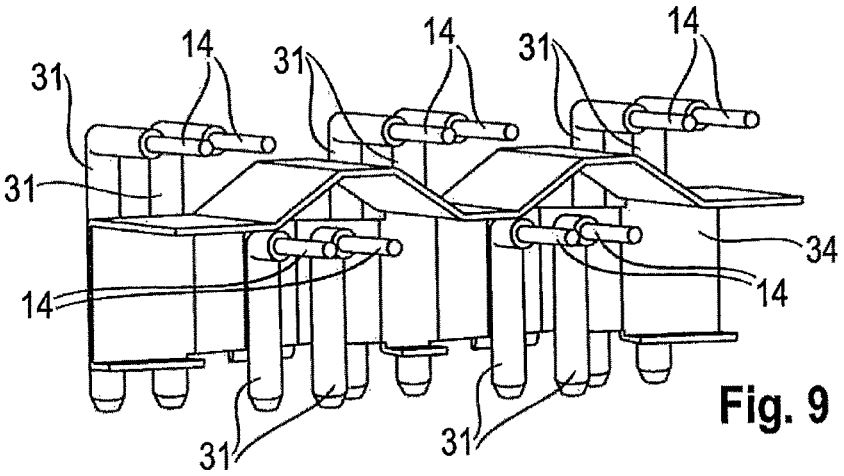
FIG. 9 is a perspective view of individual parts of the insertion-type printed circuit board connector.

FIGS. 7 to 9 are various perspective views of the insertion-type printed circuit board connector, showing it in isolation. The connector comprises the housing 11 which has a main body 25 and a cover 26. On one side, the main body 25 forms an interface for insertion which is complementary to an interface for insertion formed by the multiple insertion-type connector 1. The interface for insertion of the insertion-type printed circuit board connector 2 comprises a plurality (five in fact) of (through) openings 27 within each of which are arranged two contact elements 14 in pin form, i.e., a pair of contact elements, aligned in parallel. These latter, when the insertion-type connectors 1, 2 are in the plugged-together state, make contact with the contact elements 13 of the multiple insertion-type connector 1.

The cross-section of the openings 27 in the main body 25 is that of an elongated oval and corresponds to the cross-section of an insertion portion 28 of the housings 7 of the individual insertion-type connectors 4 of the multiple insertion-type connector 1.

The (insertion) portion 29 of the outside of the main body 25, which (insertion) portion surrounds the openings, is of a complex shape which is complementary to the inside of an insertion portion 30 of the housing 3 of the multiple insertion-type connector 1. The insertion portions 28 of the individual insertion-type connectors 4 thus engage in the openings 27 in the main body 25 of the insertion-type printed circuit board connector 2 and the insertion portion 29 of the main body 25 of the insertion-type printed circuit board connector 2 engages in the insertion portion 30 of the housing 3 of the multiple insertion-type connector 1.

In conjunction with the long-lasting fixing by the tongues for latching 10, a high mechanical load-bearing capacity can thus be obtained for the insertion-type connection. The contact elements 14 of the insertion-type printed circuit board connector 2 are integrally formed at the insertion ends of conductors 31, which latter initially extend on for a defined distance into the main body 25 co-axially to the contact elements 14 and are then bent away through 90°. Those portions of the conductors 31 which are angled away from the contact elements 14 are received in slotted openings 32 in the cover 26, and they project beyond the cover 26 and hence the housing 11 of the insertion-type printed circuit board connector 2 in this case by a defined amount. By the projecting ends, the conductors 31 are able to make contact with corresponding pads on a printed circuit board (not shown), these ends preferably engaging at the same time in openings in the printed circuit board in order to connect the insertion-type printed circuit board connector 2 to the printed circuit board mechanically as well.

Two projections 33 in spigot form which engage in corresponding openings in the printed circuit board are used to provide further mechanical stabilization. The layout of the openings 27 and hence of the pairs of contact elements too in the housing 11 of the insertion-type printed circuit board connector 2 is of a zigzag form, i.e., three of the five pairs of contact elements are arranged in a first row and the two remaining pairs of contact elements are arranged in a second row spaced from the first row in parallel therewith.

Provision is made in this case for the spacings of the two pairs of contact elements in the second row from the two pairs of contact elements respectively adjacent to them in the first row to be substantially the same, thus putting the latter in central positions relative to the former. A compact layout can thus be achieved for the pairs of contact elements in the housing 11, with as large a spacing as possible from adjacent pairs of contact elements being maintained at the same time.

Relatively low crosstalk between the pairs of contact elements can thus be achieved simply by virtue of the geometry. Such crosstalk is also reduced by a shielding element in the form of a shielding plate 34 which is arranged in a slotted receptacle in the main body 25 which extends between the first row and second row of pairs of contact elements.

The configuration of the receptacle, and hence of shielding plate 34, is not plane in this case but of a zigzag form, corresponding to the layout of the pairs of contact elements. As can be seen from FIG. 9 in particular, the shielding plate 34 is also angled through 90° and thus follows the path followed by the conductors 31.

At the same time, that portion of the shielding plate 34 which extends at an angle to the contact elements 14 separates the relevant portions of the conductors 31 into a first row and a second row, the conductors 31 in the first row also forming the contact elements 14 in the first row and the conductors 31 in the second row also forming the contact elements 14 in the second row. This layout in three dimensions for the portions of the conductors 31 which are angled relative to the contact elements 14 is achieved by making the conductors 31 in the first row on the one hand and in the second row on the other hand of different lengths. The shielding plate 34 also forms contact tabs which are intended to make contact with shielding contacts on the printed circuit board.

The main body 25 and the cover 26 of the insertion-type printed circuit board connector 2 are formed entirely of electrically non-conductive plastics material, with the geometrically simple shape of the two components simplifying manufacture by injection molding. The shielding plate 34 which is angled through 90° is likewise of a geometrically simple shape which makes production as a stamped, punched or die-cut, and bent component easy and inexpensive.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A connector system comprising an insertion-type connector including:

a housing;

at least two contact elements fixed within the housing; and a twisted-pair cable configured for signal and data transmission, two cores of the twisted-pair cable being connected to the contact elements with an electrically conductive connection, in which the cores are twisted together in at least one pair surrounded by an outer protective sheath;

the housing forming a guide by which the two cores are fixed in a twist which continues the twist of the twisted-pair cable, the cores being guided to the contact elements while still in the twist, such that, to form the guide, the housing includes, in a guiding space, at least one guiding spigot which extends transversely to a plane defined by the longitudinal axes of the contact elements and around which the cores are guided in arcs, wherein the housing comprises two parts produced by injection molding, wherein the two parts do not have any undercuts in a direction of demolding, wherein the at least one guiding spigot is formed by one of said parts, and wherein the housing is made in two parts, with a division in side-walls which are intersected by the plane defined by the longitudinal axes of the contact elements.

2. The connector system of claim 1, wherein the housing does not include shielding.

3. The connector system of claim 2, wherein the housing is formed from electrically insulating plastics material.

4. The connector system of claim 1, wherein the two contact elements are of an elongated form and are arranged parallel to one another.

5. The connector system of claim 2, wherein the two contact elements are of an elongated form and are arranged parallel to one another.

6. A method of producing a connector system comprising an insertion-type connector, which has a housing and at least two contact elements fixed within the housing, and a twisted-pair cable, the housing having in a guiding space, to form a guide, at least one guiding spigot which extends transversely to a plane defined by the longitudinal axes of the contact elements, wherein the housing comprises two parts produced by injection molding, wherein the two parts do not have any undercuts in a direction of demolding, wherein the at least one guiding spigot is formed by one of said parts, and wherein the housing is made in two parts, with a division in side-walls which are intersected by the plane defined by the longitudinal axes of the contact elements according to claim 1, the method including:

connecting with an electrically conductive connection of two cores of the twisted-pair cable, configured for signal and data transmission in which the cores are twisted together in at least one pair surrounded by an outer protective sheath, to the contact elements, twisting of a first portion of the cores situated adjacent the contact elements, fixing the first portion of the cores in the housing with the twist, in such a way that the cores are guided around the guiding spigot in arcs and are guided to the contact elements while still in the twist; and twisting of the remaining portion of the cores.

7. A connector system comprising an insertion-type connector including:

a housing;

at least two contact elements fixed within the housing; and a twisted-pair cable configured for signal and data transmission, two cores of the twisted-pair cable being connected to the contact elements with an electrically conductive connection, in which the cores are twisted together in at least one pair surrounded by an outer protective sheath;

the housing forming a guide by which the two cores are fixed in a twist which continues the twist of the twisted-pair cable, the cores being guided to the contact elements while still in the twist, such that, to form the guide, the housing includes, in a guiding space, at least one guiding spigot which extends transversely to a plane defined by the longitudinal axes of the contact elements and around which the cores are guided in arcs, wherein the housing comprises two parts produced by injection molding, wherein the at least one guiding spigot is formed by one of said parts, and at least one receiving depression is formed in the other of said parts to receive and stabilize said at least one spigot when said parts are connected together, said housing having a division in side-walls which are intersected by the plane defined by the longitudinal axes of the contact elements.

* * * * *